US009158260B2

(12) United States Patent
Suzuki et al.

(10) Patent No.: US 9,158,260 B2
(45) Date of Patent: Oct. 13, 2015

(54) IMAGE FORMING APPARATUS

(71) Applicants: Yasuhiro Suzuki, Nagoya (JP); Yohei Hashimoto, Nagakute (JP)

(72) Inventors: Yasuhiro Suzuki, Nagoya (JP); Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 210 days.

(21) Appl. No.: 13/940,334

(22) Filed: Jul. 12, 2013

(65) Prior Publication Data

US 2014/0016979 A1 Jan. 16, 2014

(30) Foreign Application Priority Data

Jul. 13, 2012 (JP) ..... 2012-157690

(51) Int. Cl.
*G03G 15/00* (2006.01)
*G03G 15/16* (2006.01)

(52) U.S. Cl.
CPC ..... *G03G 15/6529* (2013.01); *G03G 15/1615* (2013.01); *G03G 2215/0141* (2013.01)

(58) Field of Classification Search
CPC ..... G03G 15/2028; G03G 15/6576; G03G 15/602; G03G 15/6529; G03G 21/1647; G03G 2221/1657; G03G 15/1615; G03G 2215/0141
USPC ..... 399/167, 388
See application file for complete search history.

(56) References Cited

U.S. PATENT DOCUMENTS

| | | | | |
|---|---|---|---|---|
| 5,634,178 | A | 5/1997 | Sugiura et al. | |
| 6,446,556 | B1 | 9/2002 | Ida | |
| 7,496,310 | B2 | 2/2009 | Dan | |
| 2006/0239706 | A1 | 10/2006 | Dan | |
| 2008/0118274 | A1* | 5/2008 | Ahn et al. | 399/167 |
| 2009/0238621 | A1 | 9/2009 | Kubo | |
| 2011/0091237 | A1* | 4/2011 | Suzuki | 399/101 |
| 2011/0236071 | A1 | 9/2011 | Shiraki | |

FOREIGN PATENT DOCUMENTS

| | | | |
|---|---|---|---|
| JP | H05-4762 | A | 1/1993 |
| JP | H07-191592 | A | 7/1995 |
| JP | 2000-313568 | A | 11/2000 |
| JP | 2001-199610 | A | 7/2001 |

(Continued)

OTHER PUBLICATIONS

Feb. 5, 2015—(US) Final Office Action—U.S. Appl. No. 13/940,517.

(Continued)

*Primary Examiner* — Walter L Lindsay, Jr.
*Assistant Examiner* — Jessica L Eley
(74) *Attorney, Agent, or Firm* — Banner & Witcoff, Ltd.

(57) ABSTRACT

An image forming apparatus includes a developing roller, a conveyance roller which conveys a sheet; a driving source which provides a driving force to the developing roller and the conveyance roller, a developing driving gear mechanism which transmits the driving force of the driving source to the developing roller, and a conveyance driving gear mechanism which transmits the driving force of the driving source to the conveyance roller. The developing driving gear mechanism includes a developing driving switching mechanism which causes a rotating direction of the developing roller when the first driving source rotates in a first direction to be same as the rotating direction of the developing roller when the first driving source rotates in a second direction reverse to the first direction.

10 Claims, 12 Drawing Sheets

(56) References Cited

FOREIGN PATENT DOCUMENTS

| | | | |
|---|---|---|---|
| JP | 2002-003048 | A | 1/2002 |
| JP | 2002-169403 | A | 6/2002 |
| JP | 2002-351159 | A | 12/2002 |
| JP | 2004-157222 | A | 6/2004 |
| JP | 2006301364 | A | 11/2006 |
| JP | 2008-209624 | A | 9/2008 |
| JP | 2011-203361 | A | 10/2011 |

OTHER PUBLICATIONS

Non-Final Office Action received in U.S. Appl. No. 13/940,517, mailed on Jul. 18, 2014.

May 22, 2015—(US) Non-Final Office Action—U.S. Appl. No. 13/940,517.

* cited by examiner

FIG.10

| | ROTATING DIRECTION OF FIRST MOTOR | |
|---|---|---|
| | FORWARD DIRECTION | REVERSE DIRECTION |
| REGISTRATION ROLLER | FORWARD CONVEYANCE DIRECTION | FORWARD CONVEYANCE DIRECTION |
| DEVELOPING ROLLER | FORWARD CONVEYANCE DIRECTION | FORWARD CONVEYANCE DIRECTION |
| FIXING DEVICE | FORWARD CONVEYANCE DIRECTION | STOP |
| CONVEYANCE ROLLER (DISCHARGE ROLLER) | FORWARD CONVEYANCE DIRECTION | REVERSE CONVEYANCE DIRECTION |
| RE-CONVEYANCE ROLLER | FORWARD CONVEYANCE DIRECTION | FORWARD CONVEYANCE DIRECTION |

IMAGE FORMING APPARATUS

CROSS-REFERENCE TO RELATED APPLICATION

This application claims priority from Japanese Patent Application No. 2012-157690, filed on Jul. 13, 2012, the entire subject matter of which is incorporated herein by reference.

TECHNICAL FIELD

Aspects of the present invention relate to an image forming apparatus having a developing roller configured to supply developer to a photosensitive member, and a conveyance roller configured to convey a recording sheet.

BACKGROUND

For example, JP-A-2011-203361 describes an image forming apparatus such as a printer which drives a sheet discharge roller configured to convey a sheet and the like, and a developing roller configured to supply developer to a photosensitive member, with a common motor. This image forming apparatus is configured such that a rotating direction of the sheet discharge roller is switched as a rotating direction of the motor is switched.

In a configuration of driving a conveyance roller configured to convey a sheet and the developing roller with the common motor, when a rotating direction of the developing roller is switched upon switching of a rotating direction of the conveyance roller, a contact state between a surface of the photosensitive member and a surface of the developing roller is changed, so that the surfaces may be damaged such as wear and scratch.

SUMMARY

Accordingly, an aspect of the present invention provides an image forming apparatus capable of suppressing damage on a surface of a developing roller and/or a photosensitive member.

According to an illustrative embodiment of the present invention, there is provided an image forming apparatus including a rotatable photosensitive member, a developing roller, a conveyance roller, a first driving source, a second driving source, a developing driving gear mechanism, and a conveyance driving gear mechanism. The photosensitive member is configured such that a developer image is formed thereon. The developing roller is configured to supply developer to the photosensitive member while contacting the photosensitive member. The conveyance roller is configured to convey a recording sheet. The first driving source is configured to provide a driving force to the developing roller and the conveyance roller and capable of switching a rotating direction thereof between a first direction and a second direction reverse to the first direction. The second driving source is configured to provide a driving force to the photosensitive member. The developing driving gear mechanism is configured to transmit the driving force of the first driving source to the developing roller. The conveyance driving gear mechanism is configured to transmit the driving force of the first driving source to the conveyance roller. The conveyance driving gear mechanism is configured to cause a rotating direction of the conveyance roller when the first driving source rotates in the first direction to be reverse to the rotating direction of the conveyance roller when the first driving source rotates in the second direction. The developing driving gear mechanism includes a developing driving switching mechanism configured to cause a rotating direction of the developing roller when the first driving source rotates in the first direction to be same as the rotating direction of the developing roller when the first driving source rotates in the second direction.

According to the above configuration, even when the rotating direction of the first driving source is switched, the developing roller is rotated in the same direction, so that it is possible to reduce a change in the contact state between a surface of the photosensitive member and a surface of the developing roller. Thereby, it is possible to suppress the damage on the surface of the developing roller or photosensitive member.

BRIEF DESCRIPTION OF THE DRAWINGS

The above and other aspects of the present invention will become more apparent and more readily appreciated from the following description of illustrative embodiments of the present invention taken in conjunction with the attached drawings, in which:

FIGS. 6A and 6B are side views of a first swing gear, a second swing gear, a developing driving output gear and an idle gear, in which FIG. 6A shows that the first motor rotates in the forward direction and FIG. 6B shows that the first motor rotates in the reverse direction;

FIG. 10 is a table showing relations between a rotating direction of the first motor and rotating directions of a registration roller, a developing roller, a fixing device, a conveyance roller and a re-conveyance roller;

DETAILED DESCRIPTION

Hereinafter, illustrative embodiments of the invention will be specifically described with reference to the drawings. Meanwhile, in the below descriptions, a direction is described based on a user who uses a color printer 1 (an example of an image forming apparatus). That is, the right side in FIG. 1 is referred to as the 'front', the left side is referred to as the 'rear', the front side is referred to as the 'left' and the back side is referred to as the 'right.' Also, the upper and lower directions in FIG. 1 are referred to as the 'upper-lower.'

<Schematic Configuration of Color Printer>

Figure 1:
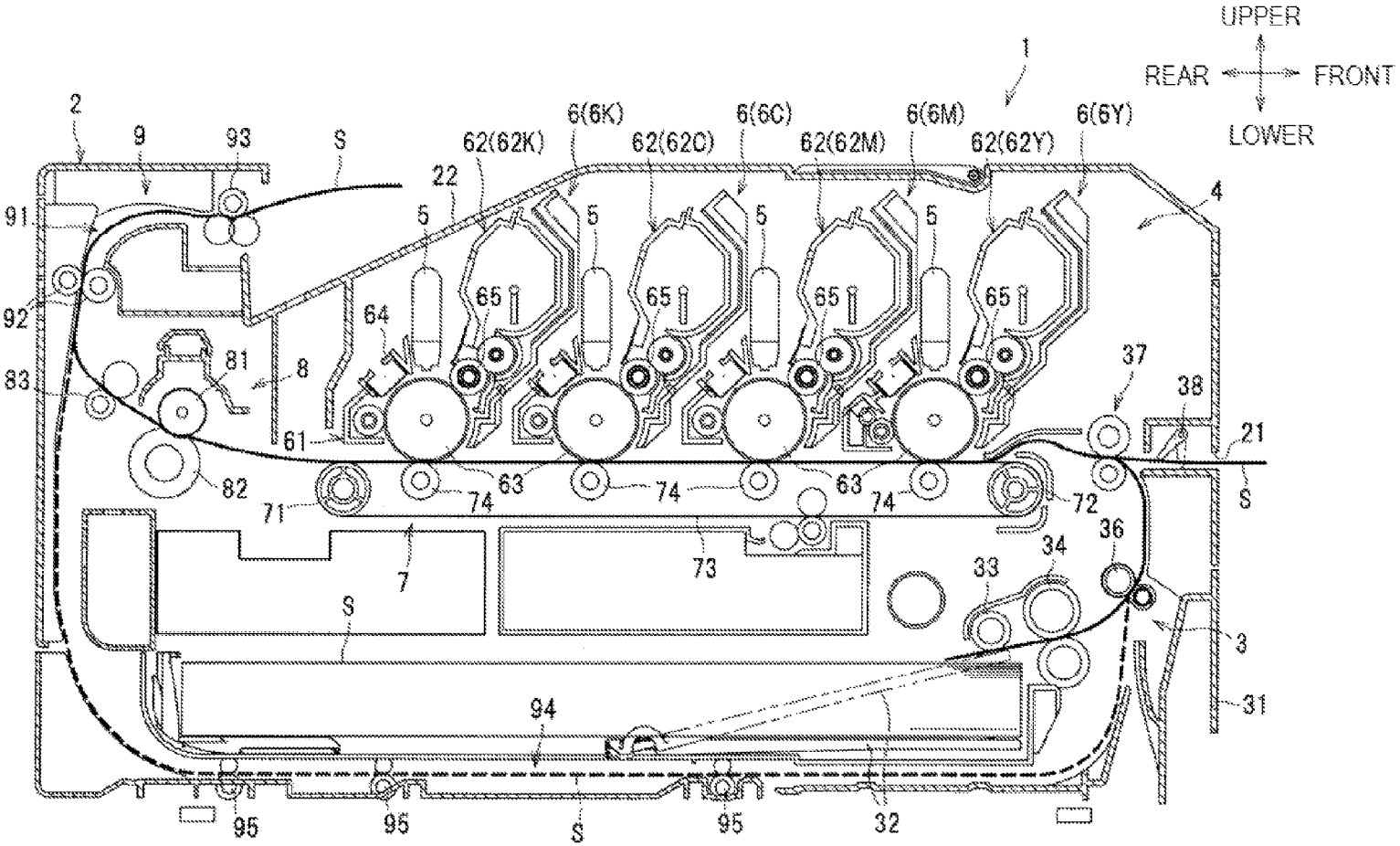
FIG. 1 shows a schematic configuration of a color printer which is an example of an image forming apparatus according to an illustrative embodiment of the present invention.

As shown in FIG. 1, a color printer 1 is configured to form an image on both sides of a sheet S (an example of a recording sheet), and mainly includes, in a body housing 2, a feeder unit 3, an image forming unit 4, a fixing device 8 and a conveyance unit 9. The body housing 2 is formed at its front side with a manual feed opening 21 through which a sheet S is inserted, and is formed at its upper surface with a sheet discharge tray 22 on which the sheet S discharged from the body housing 2 is placed.

The feeder unit 3 is provided at a lower part in the body housing 2 and mainly includes a sheet feeding tray 31 which accommodates therein a plurality of sheets S, a sheet pressing plate 32, a feeder roller 33, separation rollers 34, a conveyance roller 36 and registration rollers 37 which are used as supply rollers for supplying the sheet S into the body housing 2.

When feeding a sheet S, which is accommodated in the sheet feeding tray 31, into the image forming unit 4, the sheet S in the sheet feeding tray 31 is first inclined towards the feeder roller 33 by the sheet pressing plate 32. After that, the sheet S is fed towards the separation rollers 34 by the feeder roller 33 and separated one by one by the separation rollers 34, and is then conveyed towards the image forming unit 4 by the conveyance roller 36 and the registration rollers 37. In the meantime, when feeding a sheet S to the image forming unit 4 through the manual feed opening 21, a user first inserts the sheet S into the manual feed opening 21. Accordingly, a leading end portion of the inserted sheet S is sandwiched by the registration rollers 37, which will be specifically described later. After that, the sandwiched sheet S is fed to the image forming unit 4 in the body housing 2 by the registration rollers 37.

The image forming unit 4 mainly includes four LED units 5, four process units 6 and a transfer unit 7.

The LED unit 5 is arranged above a photosensitive drum 63 and includes a plurality of Light Emitting Diodes (LEDs) at a lower end thereof, which are arranged in a left-right direction. The LEDs are blinked based on image data, so that the LED unit exposes a surface of the photosensitive drum 63.

The process units 6 are arranged side by side in a front-rear direction between the sheet discharge tray 22 and the sheet feeding tray 31. Each process unit 6 includes a drum cartridge 61 and a developing cartridge 62 which is detachably attached to the drum cartridge 61. Each drum cartridge 61 includes the photosensitive drum 63 (an example of a photosensitive member), a charger 64 and the like. Each developing cartridge 62 includes a developing roller 65, a toner supply roller, a layer thickness regulation blade, a toner accommodation unit accommodating toner (an example of developer), and the like whose reference numerals are omitted.

The process units 6 are configured such that the process units 6Y, 6M, 6C, 6K, in which toners of respective colors of yellow, magenta, cyan and black are accommodated, are arranged side by side from the front side in this order. Hereinafter, in the specification and drawings, when specifying the photosensitive drums 63, the developing rollers 65 and the like corresponding to respective toner colors, the reference numerals Y, M, C and K are attached in correspondence to yellow, magenta, cyan and black, respectively.

The transfer unit 7 is provided between the sheet feeding tray 31 and the process units 6, and mainly includes a driving roller 71, a driven roller 72, a conveyance belt 73 (an example of an endless belt) and four transfer rollers 74. The conveyance belt 73 is wound around the driving roller 71 and the driven roller 72 and has an outer surface which is arranged to face the four photosensitive drums 63. At an inner side of the conveyance belt 73, the respective transfer rollers 74 are arranged to sandwich the conveyance belt 73 between the respective transfer rollers 74 and the respective photosensitive drums 63.

In the image forming unit 4, the surface of the photosensitive drum 63 driven to be rotated is uniformly charged by the charger 64 and is then exposed by the LED unit 5, so that an electrostatic latent image based on image data is formed on the photosensitive drum 63. The toner in the toner accommodation part is supplied to the developing roller 65 through the toner supply roller and is introduced between the developing roller 65 and the layer thickness regulation blade, so that the toner is carried on the developing roller 65 as a thin layer having a constant thickness.

The toner carried on the developing roller 65 is supplied to the electrostatic latent image formed on the photosensitive drum 63 while the developing roller 65 contacts the photosensitive drum 63. Thereby, the electrostatic latent image becomes visible, and a toner image is formed on the photosensitive drum 63 as a developing image. After that, a sheet S fed to the image forming unit 4 is conveyed between the photosensitive drums 63 and the conveyance belt 73, so that the toner images on the photosensitive drums 63 are transferred to the sheet S.

The fixing device 8 is provided at the rear of the image forming unit 4 and mainly includes a heating roller 81 and a pressing roller 82 which is arranged to face the heating roller 81 and presses the heating roller 81. In the fixing device 8, the toner images of the sheet S having the toner images transferred thereon are heat-fixed when the sheet S passes between the heating roller 81 and the pressing roller 82, so that an image is heat-fixed on the sheet S. The sheet S having the toner images heat-fixed thereon is discharged to a conveyance path 91 from the fixing device 8 by a carrying-out roller 83.

The conveyance unit 9 has a configuration of conveying the sheet S, which is carried out from the image forming unit 4, towards an outside of the body housing 2 or again towards the image forming unit 4, and mainly includes the conveyance path 91, conveyance rollers 92, a discharge roller 93, a re-conveyance path 94 and a plurality of re-conveyance rollers 95 provided on the re-conveyance path 94.

The conveyance path 91 extends upwards from the vicinity of the carrying-out roller 83 and is then curved forwards. Also, the re-conveyance path 94 extends downwards from the vicinity of the rear of the carrying-out roller 83, is curved forwards, extends forwards along the lower of the sheet feeding tray 31, is curved upwards and then extends towards the conveyance roller 36.

The conveyance rollers 92 and the discharge roller 93 are configured to switch a rotating direction between a forward conveyance direction, which is a direction of conveying the sheet S towards the outside of the body housing 2, and a reverse conveyance direction, which is a direction of conveying the sandwiched sheet S towards the re-conveyance path 94.

In the conveyance unit 9, when an image is formed on only one side of the sheet S, the sheet S carried out from the image forming unit 4 is discharged to the outside of the body housing 5 by the conveyance rollers 92 and the discharge roller 93 being rotating in the forward conveyance direction and is then placed on the sheet discharge tray 22. On the other hand, when images are formed on both sides of the sheet S, the conveyance rollers 92 and the discharge roller 93 are rotated in the reverse conveyance direction at timing before a trailing end of the sheet S is released from between the conveyance rollers 92, so that the sheet S having the toner images heat-fixed on one side is guided to the re-conveyance path 94. After that, the sheet S (refer to the broken line) is conveyed on the re-conveyance path 94 by the re-conveyance rollers 95, so that the front side and back side of the sheet is reversed. Then, the sheet is again guided to the image forming unit 4 by the conveyance roller 36 and the registration rollers 37. The sheet S having the image formed on the other side by the image forming unit 4 is carried out from the image forming unit 4, is discharged to the outside of the body housing 2 by the conveyance rollers 92 and the discharge roller 93 being rotating in the forward conveyance direction and is then placed on the sheet discharge tray 22.

Figure 2:
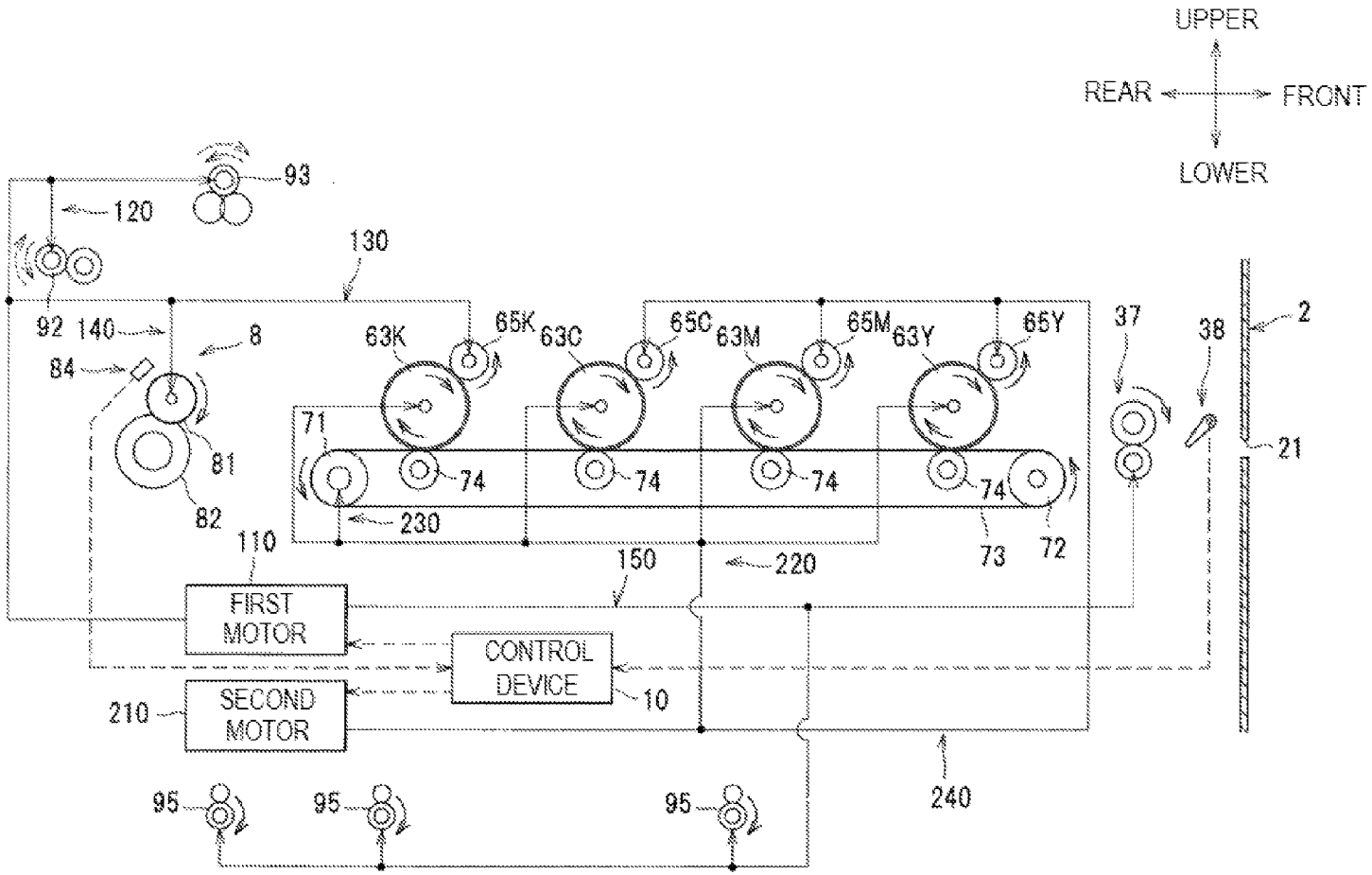
FIG. 2 shows a schematic configuration of a driving mechanism in a color mode.
Figure 3:
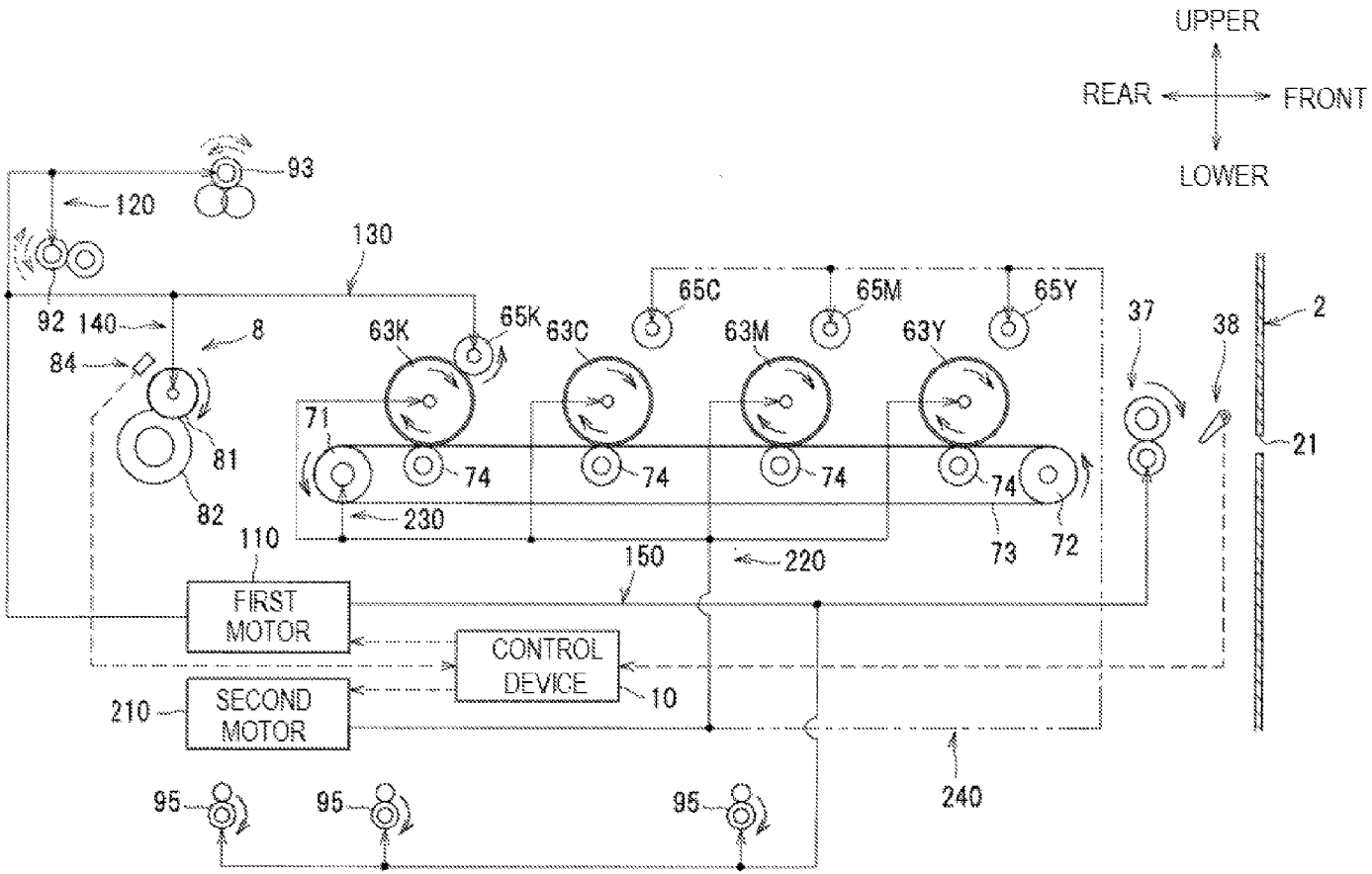
FIG. 3 shows a schematic configuration of the driving mechanism in a monochrome mode.

The color printer 1 is configured to operate in a monochrome mode in which a monochrome image is formed using only the process unit 6K and a color mode in which a color image is formed using all the process units 6Y, 6M, 6C, 6K. When operating in the color mode, all the developing rollers 65 contact the corresponding photosensitive drums 63, as shown in FIG. 2. In the meantime, when operating in the monochrome mode, the developing rollers 65Y, 65M, 65C are spaced from the corresponding photosensitive drums 63Y, 63M, 63C, as shown in FIG. 3.

<Configuration of Driving Mechanism of Color Printer>

In the below, a configuration of a driving mechanism of the color printer 1 is described.

Figure 8:
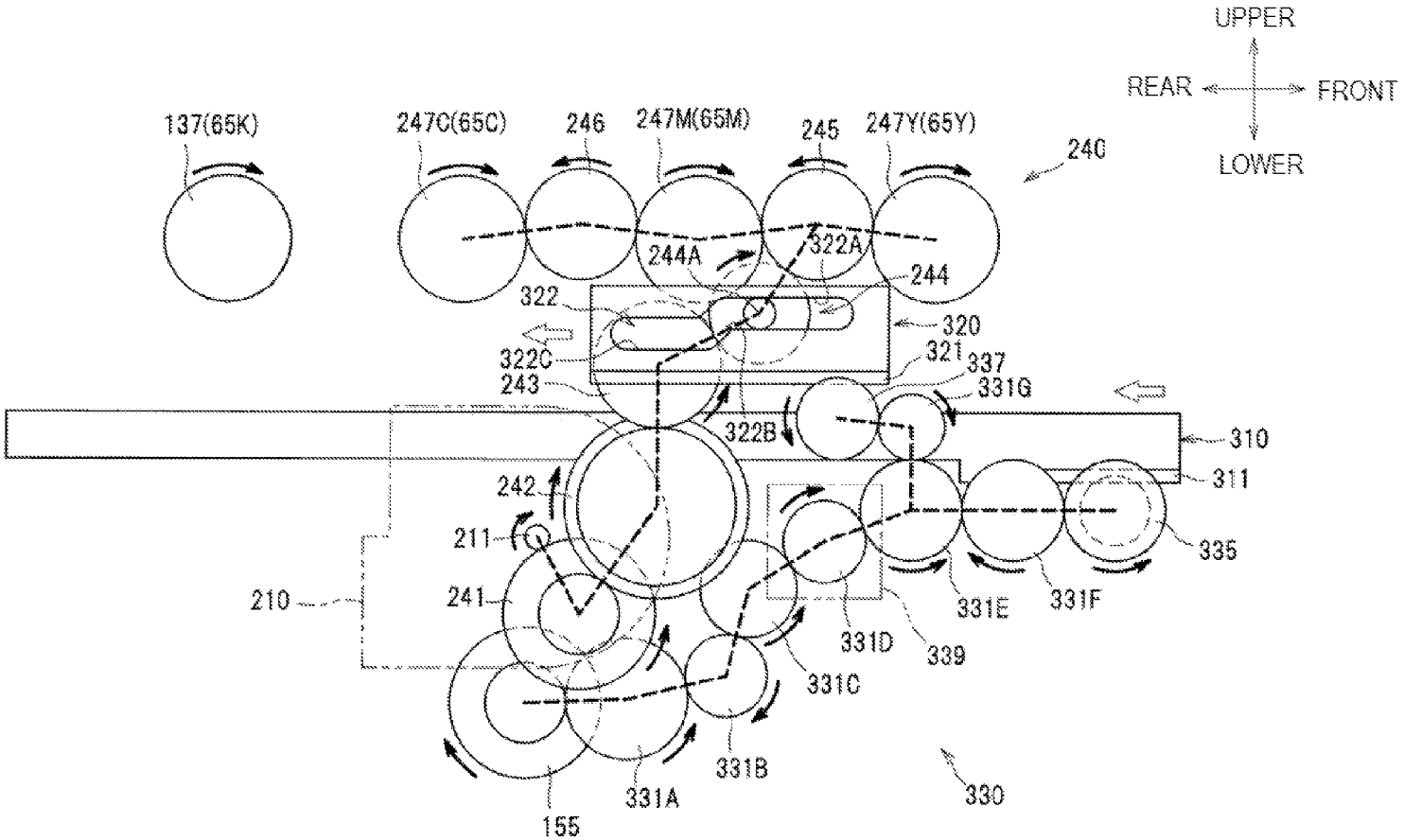
FIG. 8 shows configurations of a second developing driving gear mechanism and a cam driving gear mechanism in the color mode.
Figure 9:
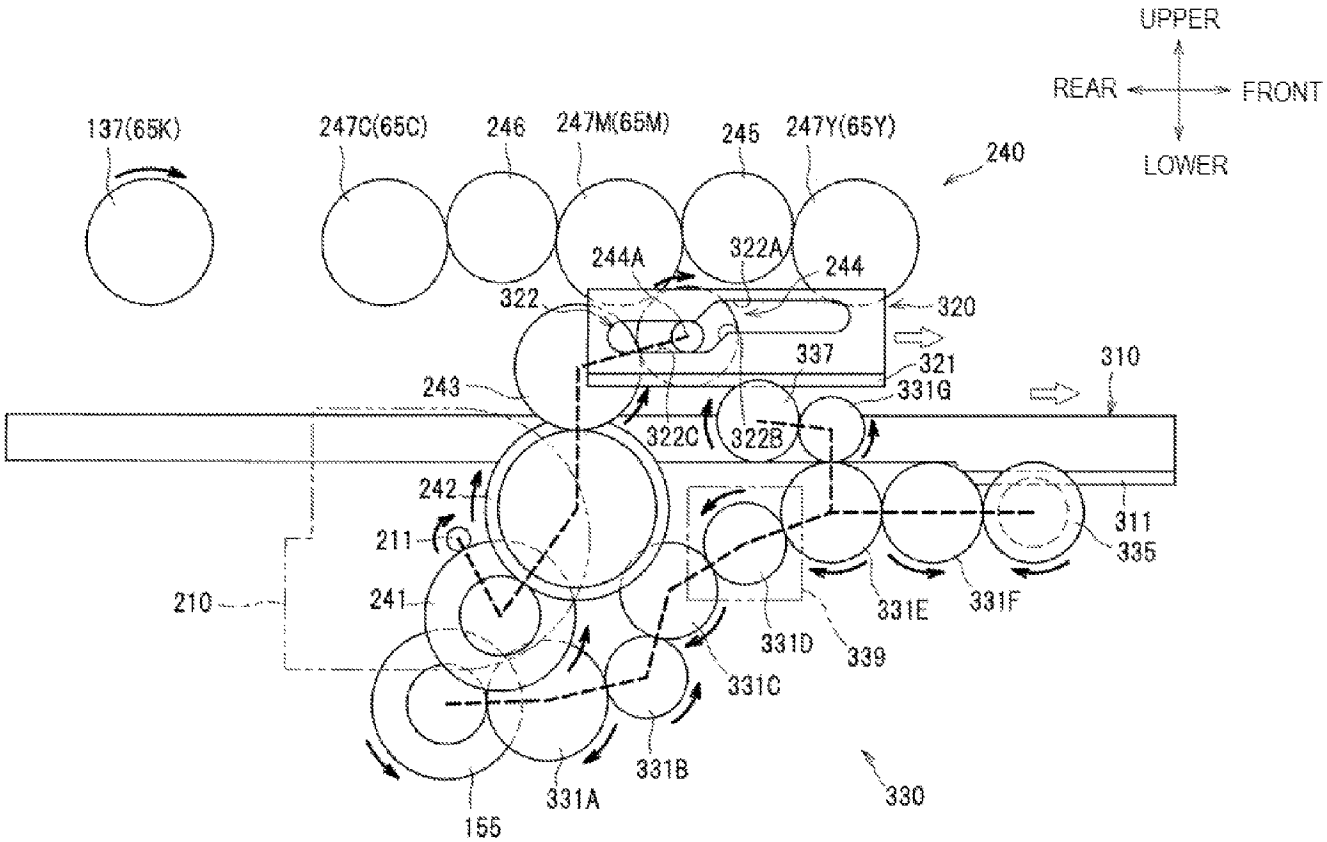
FIG. 9 shows configurations of the second developing driving gear mechanism and the cam driving gear mechanism in the monochrome mode.

As shown in FIG. 2, the color printer 1 includes a first motor 110 (an example of a first driving source), a second motor 210 (an example of a second driving source), a conveyance driving gear mechanism 120, a first developing driving gear mechanism 130 (an example of a developing driving gear mechanism), a fixing driving gear mechanism 140, a supply driving gear mechanism 150, a photosensitive member driving gear mechanism 220, a belt driving gear mechanism 230, a second developing driving gear mechanism 240, and a cam driving gear mechanism 330 (refer to FIGS. 8 and 9).

The first motor 110 is a motor which provides a driving force to the developing roller 65K (an example of a first developing roller) for supplying the black developer, the conveyance rollers 92, the discharge roller 93 and the like, and is configured to switch a rotating direction between a forward direction (an example of a first direction) of rotating the conveyance rollers 92 and the discharge roller 93 in the forward conveyance direction and a reverse direction (an example of a second direction) of rotating the conveyance rollers 92 and the discharge roller 93 in the reverse conveyance direction. Also, the second motor 210 is a motor which provides a driving force to the photosensitive drums 63, the developing rollers 65Y, 65M, 65C (an example of a second developing roller), the conveyance belt 73 and the like to rotate in the same direction. The driving/stop of the first motor 110, the switching of the rotating direction thereof and the driving/stop of the second motor 210 are controlled by a control device 10 which will be described later.

Each gear mechanism includes a plurality of gears. In this illustrative embodiment, the different gear mechanisms may share a same gear. In the meantime, in FIGS. 4 and 5, a number in a parenthesis indicates an object to which a gear having the parenthesis transmits a driving force. That is, for example, '123 (92, 93)' means that a conveyance roller gear 123 transmits a driving force to the conveyance rollers 92 and the discharge roller 93. Also, in FIGS. 4 and 5, a thick broken line indicates a driving force transmission path.

Figure 4:
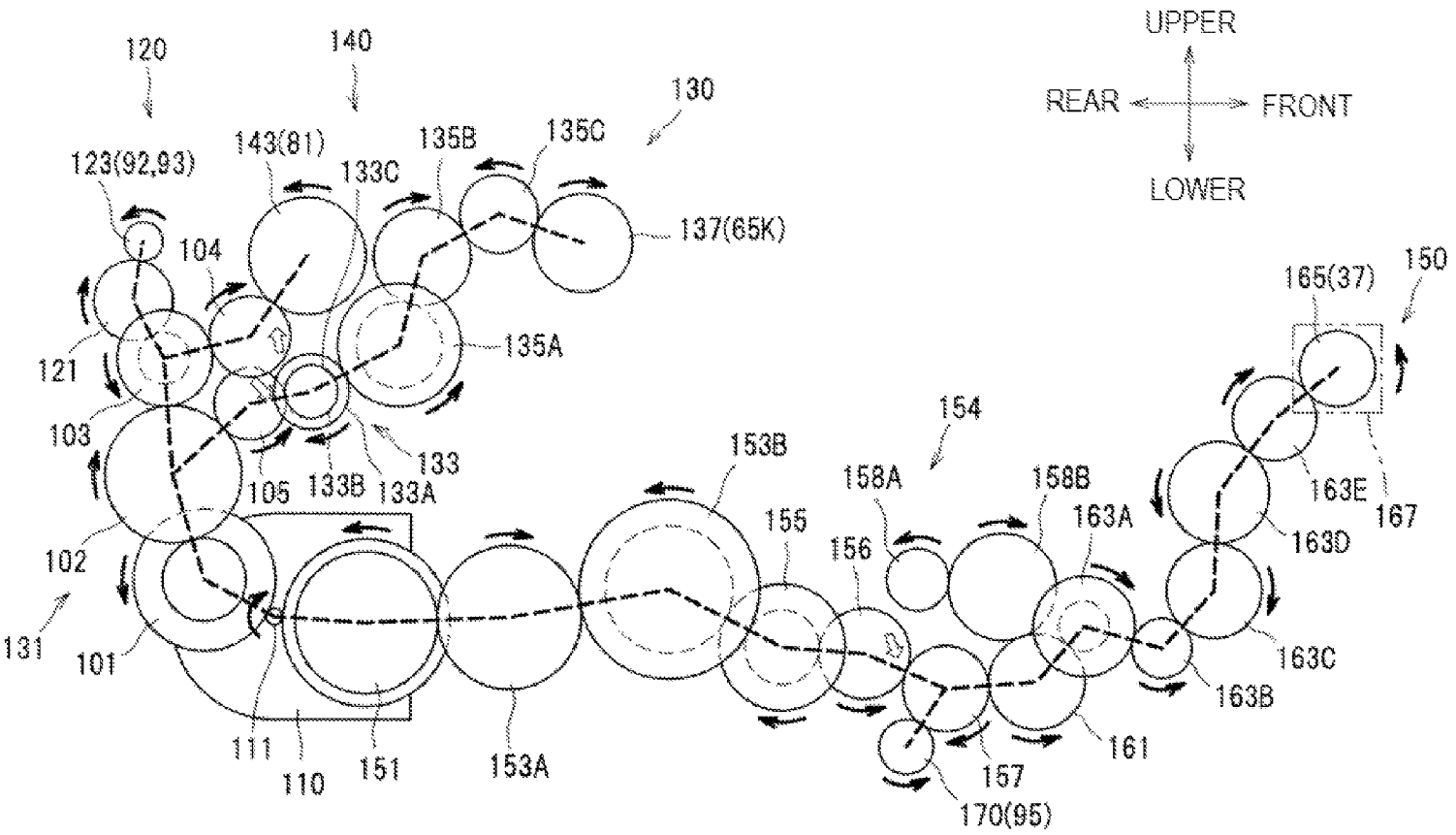
FIG. 4 shows a first developing driving gear mechanism, a conveyance driving gear mechanism, a fixing driving gear mechanism, a supply driving gear mechanism and a re-conveyance driving output gear when a first motor rotates in a forward direction.
Figure 5:
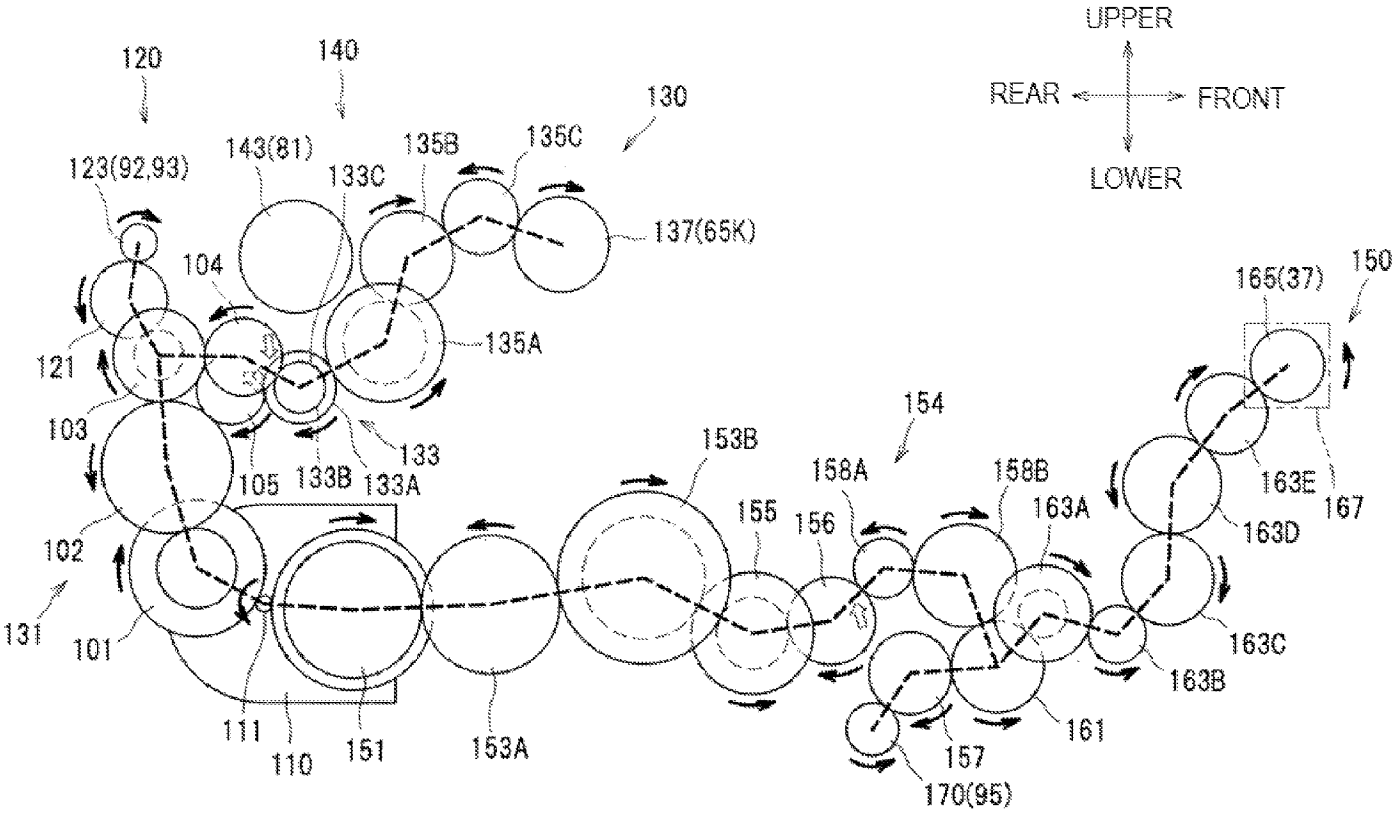
FIG. 5 shows the first developing driving gear mechanism, the conveyance driving gear mechanism, the fixing driving gear mechanism, the supply driving gear mechanism and the re-conveyance driving output gear when the first motor rotates in a reverse direction.

As shown in FIGS. 4 and 5, the conveyance driving gear mechanism 120 is a mechanism which transmits the driving force of the first motor 110 to the conveyance rollers 92, and is a gear train including an input gear 101, a first sun gear 102, a second sun gear 103, an idle gear 121 and a conveyance roller gear 123.

The input gear 101 is a gear which is meshed with a driving gear 111 configured to integrally rotate with a rotary shaft of the first motor 110. The first sun gear 102 is a gear which is meshed with the input gear 101 and to which the driving force of the first motor 110 is input from the input gear 101. The second sun gear 103 is a gear which is meshed with the first sun gear 102 and transmits the driving force to the conveyance roller gear 123 through the idle gear 121.

The conveyance roller gear 123 is a gear which integrally rotates with a rotary shaft of the conveyance roller 92. In this illustrative embodiment, the conveyance roller gear 123 is meshed with a gear train which transmits the driving force to a discharge roller gear (not shown) integrally rotating with a rotary shaft of the discharger roller 93.

The first developing driving gear mechanism 130 is a mechanism which transmits the driving force of the first motor 110 to the developing roller 65K, and includes the input gear 101, a developing driving switching mechanism 131, idle gears 135A, 135B, 135C and a first developing roller gear 137.

The first developing roller gear 137 is a gear which integrally rotates coaxially with a coupling of an apparatus-side to be engaged with a coupling provided to the developing cartridge 62.

The developing driving switching mechanism 131 is a mechanism which causes the developing roller 65K to rotate in the same rotating direction, irrespective of the rotating direction of the first motor 110, and includes the first sun gear 102, the second sun gear 103, a first swing gear 104, a second swing gear 105 and a developing driving output gear 133.

The first swing gear 104 is a gear which is meshed with the second sun gear 103 and can swing around the second sun gear 103, and is shaft-supported such that a rotary shaft of the first swing gear 104 can swing around the second sun gear 103. Specifically, the first swing gear 104 can swing between a first transmission position (refer to FIG. 5) at which the first swing gear 104 is meshed with the developing driving output gear 133 and a first interruption position (refer to FIG. 4) at which the meshing with the developing driving output gear 133 is released.

The second swing gear 105 is a gear which is meshed with the first sun gear 102 and can swing around the first sun gear 102, and is shaft-supported such that a rotary shaft of the second swing gear 105 can swing around the first sun gear 102. Specifically, the second swing gear 105 can swing between a second transmission position (refer to FIG. 4) at which the second swing gear is meshed with the developing driving output gear 133 and a second interruption position (refer to FIG. 5) at which the meshing with the developing driving output gear 133 is released. In the meantime, the second swing gear 105 is directly input with the driving force from the first sun gear 102, and the first swing gear 104 is input with the driving force from the first sun gear 102 through the second sun gear 103. Therefore, the first swing gear 104 and the second swing gear 105 are rotated in reverse directions each other.

Figure 6A:
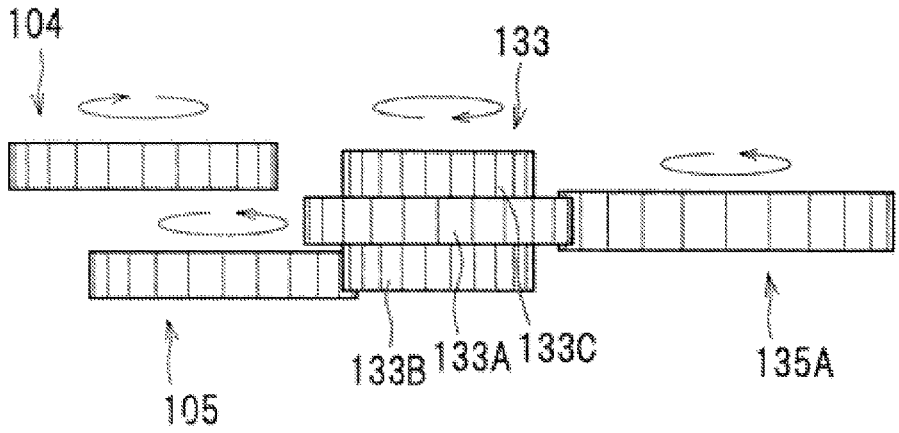
Figure 6B:
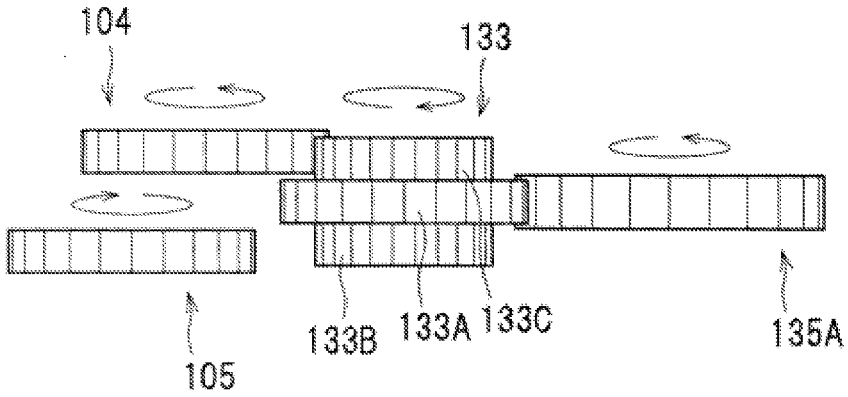

The developing driving output gear 133 is a gear which can transmit the driving force to the developing roller 65K through the idle gears 135A, 135B, 135C and the first developing roller gear 137 while either one of the first swing gear 104 swung to the first transmission position and the second swing gear 105 swung to the second transmission position is meshed with the developing driving output gear 133. As shown in FIGS. 6A and 6B, the developing driving output gear 133 has a large diameter gear 133A, which is meshed with the idle gear 135A, and small diameter gears 133B, 133C, which are provided on both sides of the large diameter gear 133A and have the same diameter smaller than that of the large diameter gear 133A, on the same axis.

The small diameter gear 133B is meshed with the second swing gear 105 swung to the second transmission position (refer to FIG. 6A) and the small diameter gear 133C is meshed with the first swing gear 104 swung to the first transmission position (refer to FIG. 6B). In FIGS. 4 and 5, the small diameter gear 133B is positioned at the back side of the large diameter gear 133A on the sheet and the small diameter gear 133C is positioned at the front side of the large diameter gear 133A on the sheet.

The fixing driving gear mechanism 140 is a mechanism which transmits the driving force of the first motor 110 to the fixing device 8, and includes the input gear 101, the first sun gear 102, the second sun gear 103, the first swing gear 104 functioning as the fixing driving interruption mechanism, and a fixing driving output gear 143.

The fixing driving output gear 143 is a gear which is meshed with a heating roller gear (not shown) integrally and coaxially rotating with the heating roller 81 and can transmit the driving force to the heating roller 81.

The first swing gear 104 functioning as the fixing driving interruption mechanism can swing between a meshing position (refer to FIG. 4) at which the first swing gear 104 is meshed with the fixing driving output gear 143 and a release position (refer to FIG. 5) at which the meshing with the fixing driving output gear 143 is released. Meanwhile, in this illustrative embodiment, the meshing position shown in FIG. 4 is the same as the first interruption position, and the release position shown in FIG. 5 is the same as the first transmission position. Therefore, when the first swing gear 104 swings to the meshing position, the meshing with the developing driving output gear 133 is released (refer to FIG. 4), and when the first swing gear 104 swings to the release position, the first swing gear 104 is meshed with the developing driving output gear 133 (refer to FIG. 5).

The supply driving gear mechanism 150 is a mechanism which transmits the driving force of the first motor 110 to the registration rollers 37, and includes an input gear 151, idle gears 153A, 153B, a supply driving switching mechanism 154, a supply driving output gear 161, idle gears 163A to 163E, a registration roller gear 165 and an electromagnetic clutch 167.

The input gear 151 is a gear which is meshed with the driving gear 111 of the first motor 110, and the registration roller gear 165 is a gear which rotates coaxially with the rotary shaft of the registration roller 37.

The supply driving switching mechanism 154 is a mechanism which rotates the registration roller 37 in the same rotating direction, irrespective of the rotating direction of the first motor 110, and includes a supply driving sun gear 155, a supply driving swing gear 156, a first supply driving gear 157 and second supply driving gears 158A, 158B.

The supply driving sun gear 155 is a gear to which the driving force of the first motor 110 is input through the input gear 151 and the idle gears 153A, 153B.

The supply driving swing gear 156 is a gear which is meshed with the supply driving sun gear 155 and can swing around the supply driving sun gear 155.

Specifically, the supply driving swing gear 156 can swing between a position (refer to FIG. 4) at which the supply driving swing gear 156 is meshed with the first supply driving gear 157 and a position (refer to FIG. 5) at which the supply driving swing gear 156 is meshed with the second supply driving gear 158A.

The first supply driving gear 157 is a gear which is meshed with the supply driving output gear 161 and transmits the input driving force to the supply driving output gear 161. The second supply driving gears 158A, 158B configure the gear train. The second supply driving gear 158B is meshed with the supply driving output gear 161 and transmits the driving force, which is input to the second supply driving gear 158A, to the supply driving output gear 161. In this illustrative embodiment, odd (one) number of the first supply driving gear 157 is provided and even (two) number of the second supply driving gears 158A, 158B are provided.

The supply driving output gear 161 is a gear which is meshed with the first supply driving gear 157 and the second supply driving gear 158B to thus transmit the driving force, which is input through the idle gears 163A to 163E and registration roller gear 165, to the registration rollers 37.

The electromagnetic clutch 167 is a known clutch which switches whether to transmit the driving force, which is input to the registration roller gear 165, to the registration rollers 37.

In this illustrative embodiment, the first supply driving gear 157 with which the supply driving swing gear 156 is directly meshed is directly meshed with a re-conveyance driving output gear 170. The re-conveyance driving output gear 170 is a gear which is meshed with a gear train and which transmits the driving force to the gear integrally rotating with rotary shafts of the re-conveyance rollers 95, and can transmit the driving force to the re-conveyance rollers 95.

When the supply driving swing gear 156 is meshed with the first supply driving gear 157, the re-conveyance driving output gear 170 is input with the driving force from the supply driving sun gear 155 through the two gears of the supply driving swing gear 156 and the first supply driving gear 157. When the supply driving swing gear 156 is meshed with the second supply driving gear 158A, the re-conveyance driving output gear 170 is input with the driving force from the supply driving sun gear 155 through the five gears of the supply driving swing gear 156, the second supply driving gears 158A, 158B, the supply driving output gear 161 and the first supply driving gear 157. Thereby, the rotating direction of the re-conveyance driving output gear 170 is the same, specifically, the rotating direction when the re-conveyance rollers 95 convey a sheet S towards the image forming unit 4 in the re-conveyance path 94, irrespective of the rotating direction of the first motor 110.

Figure 7:
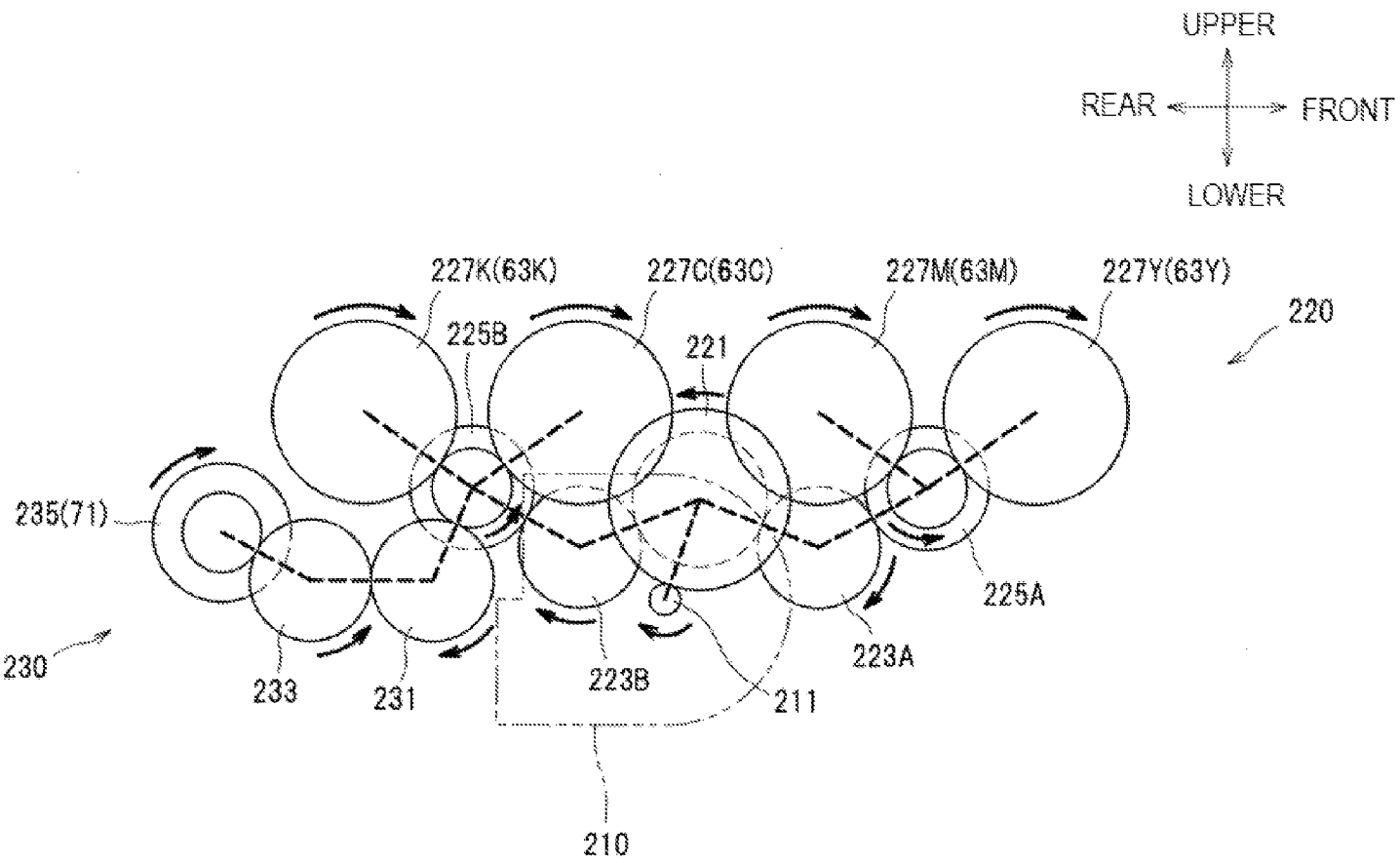
FIG. 7 shows a photosensitive member driving gear mechanism and a belt driving gear mechanism.

As shown in FIG. 7, the photosensitive member driving gear mechanism 220 is a mechanism which transmits the driving force of the second motor 210 to the four photosensitive members 63, and includes an input gear 221, idle gears 223A, 223B, 225A, 225B and drum gears 227Y, 227M, 227C, 227K. In this illustrative embodiment, the idle gears 223A, 225A and the drum gears 227Y, 227M and the idle gears 223B, 225B and the drum gears 227C, 227K are bilaterally symmetrically provided with respect to the input gear 221.

The input gear 221 is a gear which is meshed with a driving gear 211 integrally rotating with the rotary shaft of the second motor 210. Also, the drum gears 227Y, 227M, 227C, 227K are gears which are meshed with gears (not shown) integrally and coaxially rotating with the corresponding photosensitive drums 63Y, 63M, 63C, 63K and can transmit the driving force to the corresponding photosensitive drums 63Y, 63M, 63C, 63K.

The belt driving gear mechanism 230 is a mechanism which transmits the driving force of the second motor 210 to the conveyance belt 73, and is a gear train which includes the input gear 221, idle gears 223B, 225B, 232, 233 and a driving roller gear 235.

The driving roller gear 235 is a gear which is meshed with a gear (not shown) integrally rotating with a rotary shaft of the driving roller 71 and can transmit the driving force of the second motor 210 to the conveyance belt 73 through the driving roller 71.

As shown in FIG. 8, the second developing driving gear mechanism 240 is a mechanism which transmits the driving force of the second motor 210 to the developing rollers 65Y, 65M, 65C, and includes an input gear 241, an idle gear 242, a developing sun gear 243, a developing swing gear 244, and a second developing roller gear 247Y, an idle gear 245, a second developing roller gear 247M, an idle gear 246 and a second developing roller gear 247C, which form a gear train arranged in the front-rear direction.

The input gear 241 is a gear which is meshed with the driving gear 211 of the second motor 210.

The developing sun gear 243 is a gear to which the driving force of the second motor 210 is input through the input gear 241 and the idle gear 242.

The developing swing gear 244 is a gear which is meshed with the developing sun gear 243 and can swing around the developing sun gear 243. Specifically, the developing swing gear 244 can swing between a connection position (refer to FIG. 8) at which the developing swing gear 244 is meshed with the idle gear 245 and a non-connection position (refer to FIG. 9) at which the meshing with the idle gear 245 is released.

The cam driving gear mechanism 330 is a mechanism which drives a separation cam 310 and a switching cam 320, and has idle gears 331A to 331G, a separation cam driving gear 335, a switching cam driving gear 337 and an electromagnetic clutch 339. The cam driving gear mechanism 330 is input with the driving force of the first motor 110 (refer to FIGS. 4 and 5) from the supply driving sun gear 155 meshed with the idle gear 331A.

The separation cam driving gear 335 is a gear which is meshed with a rack gear 311 provided at a front end of a lower part of the separation cam 310, and can transmit the driving force to the separation cam 310. The switching cam driving gear 337 is a gear which is meshed with a rack gear 321 provided at a lower part of the switching cam 320, and can transmit the driving force to the switching cam 320. The driving force which is input from the supply driving sun gear 155 is branched from the idle gear 331E into the idle gear 331F which is meshed with the separation cam driving gear 335 and the idle gear 331G which is meshed with the switching cam driving gear 337, and the branched forces are then transmitted to the separation cam driving gear 335 and the switching cam driving gear 337, respectively.

The electromagnetic clutch 339 is a known clutch which switches whether to transmit the driving force input to the idle gear 331D, to the idle gear 331E.

The separation cam 310 is a cam configured to cause the developing rollers 65Y, 65M, 65C to contact and to separate from the corresponding photosensitive drums 63Y, 63M, 63C. The separation cam 310 is provided at a side of the process units 6 and is supported to the body housing 2 such that the separation cam 310 can be moved in the front-rear direction.

The switching cam 320 is a cam for swinging the developing swing gear 244 to the connection position (refer to FIG. 8) or the non-connection position (refer to FIG. 9) and is supported to the body housing 2 so that the switching cam 320 can be moved in the front-rear direction. The switching cam 320 has a substantially rectangular shape, when seen from a side, and has a guide hole 322 into which a rotary shaft 244A of the developing swing gear 244 is engaged and which is long in the front-rear direction. The guide hole 322 has a front side guide part 322A which extends straight from a front edge towards the rear, an inclined part 322B which extends obliquely from a rear end of the front side guide part 322A to the rear-lower and a rear side guide part 322C which extends straight from a rear end of the inclined part 322B towards the rear. Height positions of upper and lower edges of the front side guide part 322A are higher than those of upper and lower edges of the rear side guide part 322C.

<Operations of Driving Mechanism>

In the below, there will be described respective operations of the driving mechanism, specifically, (1) operations which are performed when the first motor 110 rotates in the forward direction and in the reverse direction, (2) an operation (control) which is performed when a sheet S is fed to the image forming unit 4 from the opening 21 of the body housing 2, and (3) operations which are performed when driving the separation cam 310 and the switching cam 320.

Here, briefly describing a configuration for controlling the driving mechanism, the control printer 1 includes a control device 10, a sheet sensor 38 and a temperature sensor 84 which detects a temperature of the fixing device 8, as shown in FIG. 2.

The sheet sensor 38 is a sensor which detects whether a sheet S is inserted into the opening 21 of the body housing 2 and is provided on a feeding path of the sheet S between the opening 21 and the registration rollers 37 in the body housing 2. For example, the sheet sensor 38 mainly includes an actuator which swings as the inserted sheet S abuts thereon and an optical sensor which detects the swinging of the actuator.

The control device 10 is a device which controls the first motor 110, the second motor 210, the electromagnetic clutches 167, 339 and the like and is arranged at an appropriate position in the body housing 2. The control device 10 includes a Central Processing Unit (CPU), a Random Access Memory (RAM), a Read Only Memory (ROM), an Input/Output (I/O) interface and the like (which are not shown) and executes the control by performing respective calculation processing, based on detection results of the sheet sensor 38, the temperature sensor 84 and the like, preset programs and the like.

[Operations Performed when First Motor Rotates in Forward and Reverse Directions]

The control device 10 rotates the first motor 110 in the forward direction, for example, when executing a series of image forming operations of feeding the sheet S towards the image forming unit 4 while forming the toner images on the photosensitive drums 63, transferring and heat-fixing the toner images formed on the photosensitive drums 63 on the fed sheet S and then conveying the sheet S towards the outside of the body housing 2. The control device 10 rotates the first motor 110 in the reverse direction, for example, when executing the re-conveyance operation of guiding the sheet S, which is sandwiched between the conveyance rollers 92 and the discharge roller 93, to the re-conveyance path 94 (refer to FIG. 1) so as to form images on the back side of the sheet S. Also, the control device 10 drives the second motor 210 when executing the image forming operation or re-conveyance operation. Here, the rotating direction of the second motor 210 is the same when executing the image forming operation and when executing the re-conveyance operation. In the meantime, since the control of switching the rotating direction of the first motor 110 is known, the detailed descriptions thereof are here omitted.

As shown in FIG. 4, when the first motor 110 rotates in the forward direction, the first swing gear 104 swings to the first interruption position at which the first swing gear 104 is not meshed with the developing driving output gear 133, i.e., the meshing position at which the first swing gear 104 is meshed with the fixing driving output gear 143, the second swing gear 105 swings to the second transmission position at which the second swing gear 105 is meshed with the developing driving output gear 133 and the supply driving swing gear 156 swings to the position at which the supply driving swing gear 156 is meshed with the first supply driving gear 157. When the driving force is transmitted, the conveyance roller gear 123, the first developing roller gear 137, the fixing driving output gear 143, the registration roller gear 165 and the re-conveyance driving output gear 170 are respectively rotated in arrow directions of FIG. 4.

When the second motor 210 is driven, as shown in FIG. 7, the drum gears 227Y, 227M, 227C, 227K and the driving roller gear 235 are rotated in arrow directions of FIG. 7, and as shown in FIG. 8, the second developing roller gears 247Y, 247M, 247C are respectively rotated in arrow directions of FIG. 8, which are the same as the rotating direction of the first developing roller gear 137. In the meantime, when forming an image on the sheet S, the control device 10 controls the electromagnetic clutch 339 and interrupts the transmission of the driving force, which is input to the idle gear 331D, to the idle gear 331E. Therefore, in this case, the idle gears 331E, 331F, 331G, the separation cam driving gear 335 and the switching cam driving gear 337 are stopped.

By the above rotations of the respective gears, as shown in FIG. 2, the registration rollers 37, the respective photosensitive drums 63, the driving roller 71, the conveyance belt 73, the heating roller 81, the conveyance rollers 92, the discharge roller 93 and the re-conveyance rollers 95 are rotated in the forward direction which is the arrow direction shown with the solid line, and the respective developing rollers 65 are rotated in a counterclockwise direction of FIG. 2. Here, in the below descriptions, the counterclockwise direction of FIG. 2 as regards the developing roller 65 is referred to as a 'forward conveyance direction' for the developing roller 65.

In the meantime, as shown in FIG. 5, when the first motor 110 is rotated in the reverse direction, the first swing gear 104 swings to the release position at which the meshing with the fixing driving output gear 143 is released, i.e., the first transmission position at which the first swing gear 104 is meshed with the developing driving output gear 133, the second swing gear 105 swings to the second interruption position at which the meshing with the developing driving output gear 133 is released and the supply driving swing gear 156 swings to the position at which the supply driving swing gear 156 is meshed with the second supply driving gear 158A. At this time, after the first swing gear 104 is meshed with the developing driving output gear 133, the meshed state between the second swing gear 105 and the developing driving output gear 133 is released. That is, when the driving force is transmitted, the number of the gears to be involved is changed from even to odd or from odd to even by the swinging of the gears, so that the registration roller gear 165, the re-conveyance driving output gear 170 and the first developing roller gear 137 are respectively rotated in the same directions as those when the first motor 110 is rotated in the forward direction. In the meantime, the conveyance roller gear 123 is rotated in the reverse direction to that when the first motor 110 is rotated in the forward direction, because the number of the gears to be involved is not changed. Also, the fixing driving output gear 143 is stopped because the driving force is not input thereto.

Since the second motor 210 is rotated in the same direction, the drum gears 227Y, 227M, 227C, 227K, the driving roller gear 235 and the second developing roller gears 247Y, 247M, 247C are respectively rotated in the same directions as those when the first motor 110 is rotated in the forward direction (refer to FIGS. 7 and 8).

By the above rotations of the respective gears, as shown in FIGS. 2 and 10, the registration rollers 37, the respective photosensitive drums 63, the developing rollers 65, the driving roller 71, the conveyance belt 73 and the re-conveyance rollers 95 are rotated in the forward conveyance direction which is the same as that when the first motor 110 is rotated in the forward direction. Also, the conveyance rollers 92 and the discharge roller 93 are rotated in the reverse conveyance direction which is reverse to that when the first motor 110 is rotated in the forward direction and which is the arrow direction shown with the broken line. Also, the heating roller 81 of the fixing device 8 is stopped.

In the color printer 1, even when the rotating direction of the first motor 110 is switched, the developing roller 65K is rotated in the same direction. Therefore, it is possible to reduce a change of the contact state between the surface of the photosensitive drum 63K and the surface of the developing roller 65K. Specifically, since the developing roller 65K and the photosensitive drum 63K are rotated in the reverse directions each other, irrespective of the rotating direction of the first motor 110, the contacting surfaces each other are moved towards the same direction all the time. Thereby, since the rubbing between the surface of the developing roller 65K and the surface of the photosensitive drum 63K is suppressed regardless of the rotating direction of the first motor 110, it is possible to reduce a change of the contact state between the surface of the photosensitive drum 63K and the surface of the developing roller 65K, which change is caused by the switching of the rotating direction of the first motor 110. As a result, it is possible to suppress the damage such as wear and scratch on the surface of the developing roller 65K and the surface of the photosensitive drum 63K.

Meanwhile, in the color printer 1, when the first motor 110 is rotated in the forward direction (refer to FIG. 4), the first swing gear 104 is used as the gear transmitting the driving force to the heating roller 81, and when the first motor 110 is rotated in the reverse direction (refer to FIG. 5), the first swing gear 104 is used as the gear transmitting the driving force to the developing roller 65K. Thereby, it is possible to effectively use the first swing gear 104 and to reduce the number of gears (components) of the apparatus as a whole. Also, when the first motor 110 is rotated in the reverse direction, the fixing device 8 is stopped. Therefore, the reverse rotation of the heating roller 81 and the like is prevented and it is possible to suppress the unnecessary load and the like from being applied to the heating roller 81 and the pressing roller 82 which is rotated by following of the rotating of the heating roller 81.

Also, the developing roller 65K is arranged at the position closer to the fixing device 8 than the developing rollers 65Y, 65M, 65C (refer to FIG. 1). Thus, it is possible to easily implement the configuration where the first swing gear 104 is used as both the gear transmitting the driving force to the developing roller 65K and the gear transmitting the driving force to the heating roller 81, while reducing the total number of the gears.

Also, in the color printer 1, the re-conveyance driving output gear 170 is meshed with the first supply driving gear 157, so that the first supply driving gear 157 is also used as the gear transmitting the driving force to the re-conveyance rollers 95. Thereby, it is possible to effectively use the first supply driving gear 157 and to reduce the number of the gears.

Also, the re-conveyance driving output gear 170 is directly meshed with the first supply driving gear 157 which is directly meshed with the supply driving swing gear 156. Thus, when the first motor 110 is rotated in the forward direction shown in FIG. 4 and the re-conveyance rollers 95 thus convey the sheet S, it is possible to transmit the driving force, which is input from the supply driving swing gear 156, to the re-conveyance driving output gear 170 through only the first supply driving gear 157. Thereby, compared to a configuration where the driving force is transmitted through a plurality of gears, it is possible to reduce a torque loss. Therefore, when conveying the sheet S to be applied with load to the re-conveyance rollers 95, it is possible to effectively transmit the driving force. Meanwhile, at a state where the first motor 110 is rotated in the reverse direction shown in FIG. 5, the control device 10 causes the first motor 110 to rotate in the forward direction shown in FIG. 4 at appropriate timing after the trailing end of the sheet S guided to the re-conveyance path 94 is released from between the conveyance rollers 92.

[Operation Performed when Sheet is Fed to Image Forming Unit from Opening of Body Housing]

Figure 11:
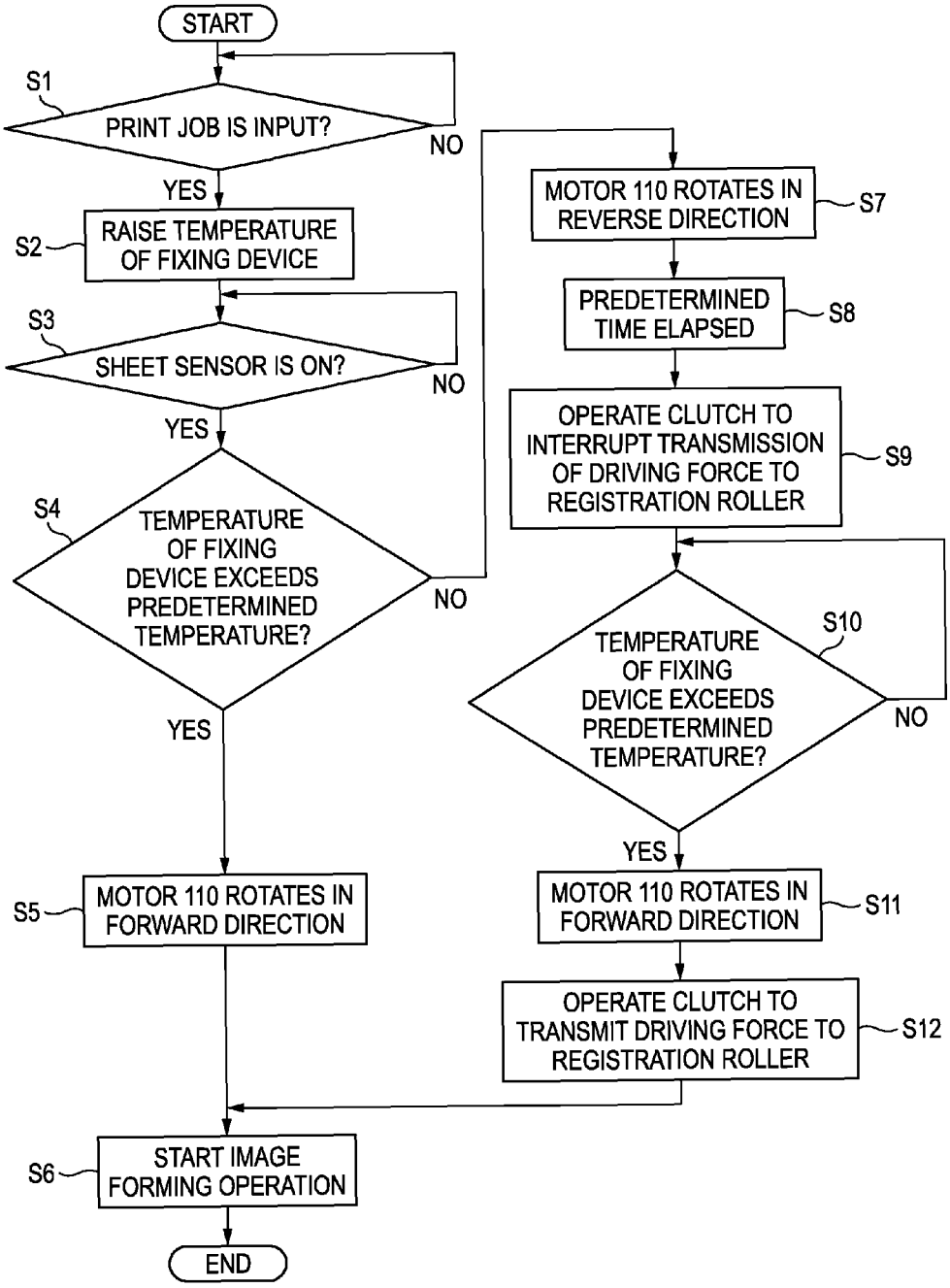
FIG. 11 shows operations performed when a recording sheet is fed to an image forming unit from a manual feed opening.

Referring to FIG. 11, when a print job including an instruction to start the image formation, image data and the like is input (S1), the control device 10 raises the temperature of the fixing device 8 (S2). When the sheet sensor 38 detects that the sheet S is inserted into the opening 21 (S3: Yes) and the temperature of the fixing device 8 exceeds a preset predetermined temperature (S4: Yes), the control device 10 causes the first motor 110 to rotate in the forward direction and drives the second motor 210 as a preparation operation for the image formation (S5). Thereby, the registration rollers 37, the photosensitive drums 63, the developing rollers 65, the conveyance belt 73, the heating roller 81, the conveyance rollers 92 and the discharge roller 93 are respectively rotated in the forward conveyance direction, as described above, and the image forming operation of forming the toner images on the photosensitive drums 63, feeding the sheet S and the like starts (S6).

In the meantime, when the sheet sensor 38 detects that the sheet S is inserted into the opening 21 (S3: Yes) but the temperature of the fixing device 8 is the predetermined temperature or lower (S4: No), the control device 10 causes the first motor 110 to rotate in the reverse direction (S7) and drives the second motor 210. Thereby, the registration rollers 37, the photosensitive drums 63, the developing rollers 65 and the conveyance belt 73 are respectively rotated in the forward conveyance direction and the conveyance rollers 92 and the discharge roller 93 are respectively rotated in the reverse conveyance direction. Also, the heating roller 81 is not driven and is kept at a stopped state. After the motors 110, 210 are driven and then the predetermined time has elapsed (S8), the control device 10 controls the electromagnetic clutch 167 (refer to FIG. 5) to thus interrupt the transmission of the driving force, which is input to the registration roller gear 165, to the registration rollers 37 (S9). Thereby, the rotations of the registration rollers 37 are stopped.

In the above operations, the sheet S inserted into the opening 21 is sandwiched by the registration rollers 37 rotating in the forward conveyance direction and is kept with being sandwiched between the registration rollers 37 while the registration rollers 37 are stopped thereafter. After that, when the temperature of the fixing device 8 exceeds the predetermined temperature (S10: Yes), the control device 10 causes the first motor 110 to rotate in the forward direction (S11) and controls the electromagnetic clutch 167 such that the driving force is transmitted to the registration rollers 37 (S12), thereby starting the image forming operation (S6). Accordingly, the sheet S sandwiched between the registration rollers 37 is fed to the image forming unit 4, so that an image is formed.

According to the above operations, when the sheet S is inserted in the opening 21, the heating roller 81 of the fixing device 8 is not driven if the temperature of the fixing device 8 is the predetermined temperature or lower. Therefore, it is possible to suppress the toner attached on the surface of the heating roller 81 or the pressing roller 82 from being scattered, which is caused due to the low-temperature driving of the fixing device 8. In the meantime, even when the temperature of the fixing device 8 is the predetermined temperature or lower, the registration rollers 37 are rotated in the direction of feeding the sheet S into the body housing 2, so that it is possible to sandwich the sheet S inserted in the opening 21 by the registration rollers 37. Thereby, since a user does not have to hold the sheet S inserted in the opening 21, it is possible to improve the operability when using the manual feeding.

Also, even when it takes certain amount of time for the fixing device 8 to exceed the predetermined temperature in a low-temperature environment, the color printer 1 can appropriately stop the driving of the registration rollers 37 by the electromagnetic clutch 167. Therefore, it is possible to temporarily hold the sheet S with being sandwiched between the registration rollers 37 without feeding the sheet S into the body housing 2 until the fixing device 8 reaches the proper temperature. Thereby, it is possible to further improve the operability when using the manual feeding.

In the meantime, when the print job is input, the control device 10 is configured to cause the first motor 110 to rotate in the reverse direction if the sheet S is inserted in the opening 21 and the temperature of the fixing device 8 is the predetermined temperature or lower. However, the present invention is not limited thereto. For example, when the sheet S is inserted in the opening 21 and the temperature of the fixing device 8 is the predetermined temperature or lower, the control device 10 may be configured to cause the first motor 110 to rotate in the reverse direction, irrespective of whether a print job is input or not. According to this configuration, since it is possible to set the sheet S for manual feeding into the opening 21 before a print job is input, it is possible to improve the operability when using the manual feeding.

[Operations Performed when Driving Separation Cam and Switching Cam]

As shown in FIG. 8, when driving the separation cam 310 and the switching cam 320, the control device 10 controls the electromagnetic clutch 339 such that the driving force can be transmitted to the idle gear 331E, and drives the first motor 110.

Specifically, when separating the developing rollers 65Y, 65M, 65C from the corresponding photosensitive drums 63Y, 63M, 63C, the control device 10 causes the first motor 110 to rotate in the reverse direction (refer to FIG. 5). Thereby, since the separation cam 310 is moved forwards from the position shown in FIG. 8 to the position shown in FIG. 9, the developing cartridges 62Y, 62M, 62C are lifted up by a known cam mechanism (not shown) provided to the separation cam 310 and the developing rollers 65Y, 65M, 65C are separated from the corresponding photosensitive drums 63Y, 63M, 63C (refer to FIG. 3).

At this time, like the separation cam 310, the switching cam 320 is also moved forwards from the position shown in FIG. 8 to the position shown in FIG. 9. Thereby, the rotary shaft 244A of the developing swing gear 244 is relatively moved from the front side guide part 322A to the rear side guide part 322C via the inclined part 322B in the guide hole 322, so that it is pushed down. Therefore, the developing swing gear 244 swings to the non-connection position at which the meshing with the idle gear 245 is released.

As a result, when the color printer 1 is in the monochrome mode where the developing rollers 65Y, 65M, 65C are separated from the corresponding photosensitive drums 63Y, 63M, 63C, the transmission of the driving from the second motor 210 to the second developing roller gears 247Y, 247M, 247C is interrupted, so that the developing rollers 65Y, 65M, 65C are not rotated. Thereby, it is possible to suppress the toners from being scattered, which is caused due to the rotations of the developing rollers 65 separated from the photosensitive drums 63.

In the meantime, when bringing the developing rollers 65Y, 65M, 65C into contact with the corresponding photosensitive drums 63Y, 63M, 63C, the control device 10 causes the first motor 110 to rotate in the forward direction (refer to FIG. 4). Thereby, since the separation cam 310 is moved rearwards from the position shown in FIG. 9 to the position shown in FIG. 8, the developing cartridges 62Y, 62M, 62C, which are supported and lifted up by the known cam mechanism, are lowered downwards and the developing rollers 65Y, 65M, 65C are contacted to the corresponding photosensitive drums 63Y, 63M, 63C (refer to FIG. 2).

At this time, like the separation cam 310, the switching cam 320 is also moved rearwards from the position shown in FIG. 9 to the position shown in FIG. 8. Thereby, the rotary shaft 244A of the developing swing gear 244 is relatively moved from the rear side guide part 322C to the front side guide part 322A via the inclined part 322B in the guide hole 322, so that it is lifted up. Therefore, the developing swing gear 244 swings to the connection position at which the developing swing gear 244 is meshed with the idle gear 245.

As a result, when the color printer 1 is in the color mode where the developing rollers 65Y, 65M, 65C contact the corresponding photosensitive drums 63Y, 63M, 63C, the driving force is transmitted from the second motor 210 to the second developing roller gears 247Y, 247M, 247C, so that the developing rollers 65Y, 65M, 65C are rotated.

<Modified Illustrative Embodiments>

While the present invention has been shown and described with reference to certain illustrative embodiments thereof, it will be understood by those skilled in the art that various changes in form and details may be made therein without departing from the spirit and scope of the invention as defined by the appended claims.

Figure 12A:
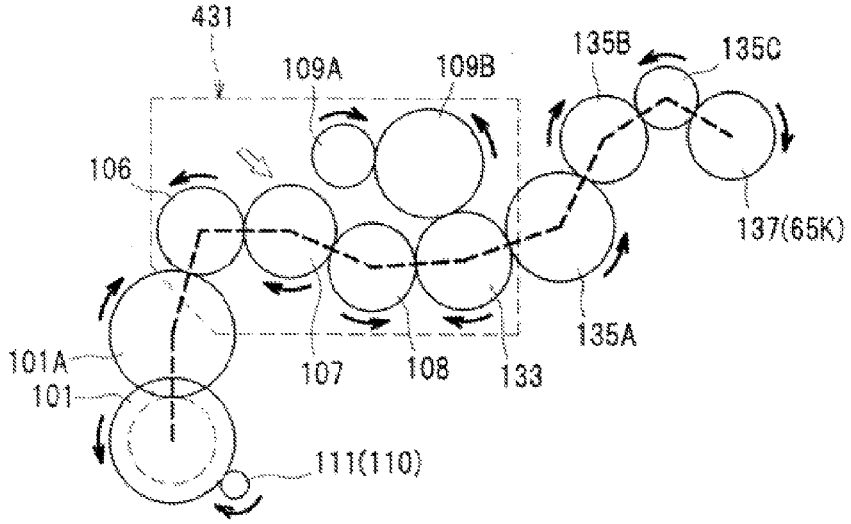
FIGS. 12A and 12B show a developing driving switching mechanism according to a modified illustrative embodiment.
Figure 12B:
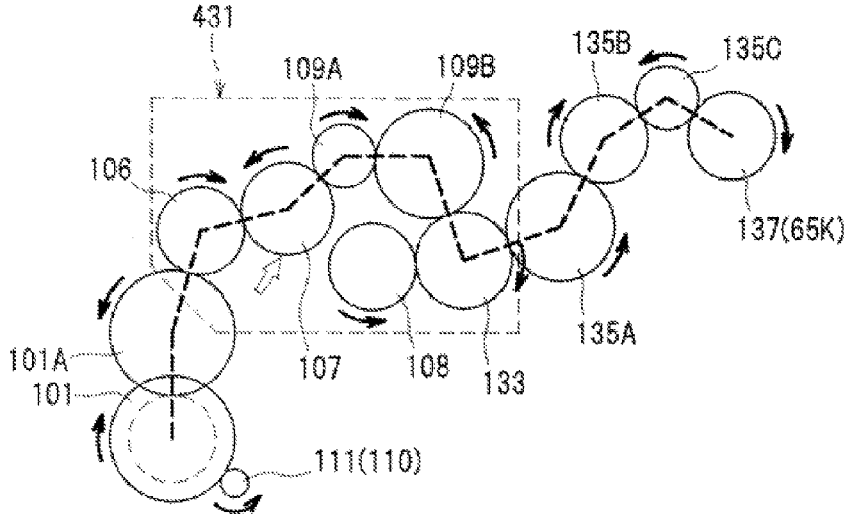

In the above illustrative embodiment, the developing driving switching mechanism 131 (refer to FIGS. 4 and 5) includes the two sun gears 102, 103 and the two swing gears 104, 105. However, the present invention is not limited thereto. For example, as shown in FIGS. 12A and 12B, a developing driving switching mechanism 431 may include only one sun gear and one swing gear. Specifically, a developing driving switching mechanism 431 shown in FIGS. 12A and 12B includes a developing driving sun gear 106 to which the driving force of the first motor 110 is input through the input gear 101 and the idle gear 101A, a developing driving swing gear 107 which is meshed with the developing driving sun gear 106 and can swing around the developing driving sun gear 106, and idle gears 108, 109A, 109B. The developing driving swing gear 107 is meshed with the idle gear 108 when the first motor 110 is rotated in the forward direction (refer to FIG. 12A) and is meshed with the idle gear 109A when the first motor 110 is rotated in the reverse direction (refer to FIG. 12B). As the developing driving swing gear 107 swings, the number of the gears involved between the developing driving swing gear 107 and the developing driving output gear 133 is changed from odd to even or from even to odd, so that the developing roller 65K is rotated in the same direction, irrespective of the rotating direction of the first motor 110.

In the above illustrative embodiment, the registration rollers 37 have been exemplified as the supply roller. However, the present invention is not limited thereto. In other words, any supply roller is possible insomuch as it supplies the sheet inserted in the manual feeding opening into the apparatus body while sandwiching the same. For example, referring to FIG. 1, a sheet conveyance roller which is provided between the registration rollers 37 and the opening 21 may be considered as the supply roller. Also, in the above illustrative embodiment, the conveyance rollers 92 which are provided between the carrying-out roller 83 and the discharge roller 93 have been exemplified as the conveyance roller. However, the present invention is not limited thereto. For example, the discharger roller 93 of the above illustrative embodiment may be considered as the conveyance roller.

In the above illustrative embodiment, the configuration of the image forming unit is exemplary and the present invention is not limited thereto. For example, in the above illustrative embodiment, the LED unit 5 has been exemplified as the member for exposing the photosensitive drum 63. However, the present invention is not limited thereto. For example, a laser scanner may be also used. Also, in the above illustrative embodiment, the photosensitive drum 63 has been exemplified as the photosensitive member. However, the present invention is not limited thereto. For example, a photosensitive belt may be used as the photosensitive member. Also, in the above illustrative embodiment, the conveyance belt 73 has been exemplified as the endless belt. However, the present invention is not limited thereto. For example, an intermediate transfer belt can be also used as the endless belt.

In the above illustrative embodiment, the fixing device 8 including the heating roller 81 and the pressing roller 82 has been exemplified. However, the present invention is not limited thereto. For example, a fixing device of a belt fixing type may be adopted.

In the above illustrative embodiment, the developing rollers including the developing roller 65K serving as the first developing roller to which the driving force is applied from the first motor 110 functioning as the first driving source and the developing rollers 65Y, 65M, 65C serving as the second developing roller to which the driving force is applied from the second motor 210 functioning as the second driving source. However, the present invention is not limited thereto. For example, all the developing rollers may be applied with the driving force from the first driving source.

In the above illustrative embodiment, the first swing gear 104 has been exemplified as the fixing driving interruption mechanism. However, the present invention is not limited thereto. For example, referring to FIG. 4, the fixing driving interruption mechanism may have a gear train which can transmit the driving force from the second sun gear 103 to the fixing driving output gear 143 and a clutch which switches whether to transmit the driving force between the gear trains.

In the above illustrative embodiment, the supply driving switching mechanism 154 has the configuration where the first supply driving gear 157 is one (odd) and the second supply driving gears 158A, 158B are two (even). However, the present invention is not limited thereto. For example, when a distance from the first driving source to the supply roller is long, the number of the respective supply driving gears may be increased. Also, the first supply driving gear 157 may be provided by an even number and the second supply driving gear may be provided by an odd number depending on the rotating direction of the supply driving swing gear.

In the above illustrative embodiment, the re-conveyance driving output gear 170 is directly meshed with the first supply driving gear 157 with which the supply driving swing gear 156 is directly meshed. However, the present invention is not limited thereto. For example, referring to FIG. 4, the re-conveyance driving output gear 170 may be meshed with the second supply driving gear 158A or the second supply driving gear 158B.

In the above illustrative embodiment, the different gears may share the same gear. However, the present invention is not limited thereto. For example, the respective gear mechanisms may be independently provided without sharing the gear.

In the above illustrative embodiment, the color printer 1 which can form both a color image and a monochrome image has been exemplified as the image forming apparatus. However, the present invention is not limited thereto. For example, the inventive concept of the present invention can be also applied to a printer which can form only a monochrome image. In other words, in the above illustrative embodiment, the color printer 1 having the developing rollers 65 and the photosensitive members, which are provided in correspondence to each of the developing rollers 65 (the first developing roller and the second developing roller), has been exemplified. However, the present invention is not limited thereto. For example, the inventive concept of the present invention can be applied to a printer having only one developing roller and one photosensitive member. Also, the image forming apparatus is not limited to the printer and may be a copier or a complex machine having a document reading apparatus such as flat type scanner.

In the above illustrative embodiment, the sheet S such as normal sheet and postcard has been exemplified as the recording sheet. However, the present invention is not limited thereto. For example, an OHP sheet is also possible.

What is claimed is:

1. An image forming apparatus comprising:

a rotatable photosensitive member on which a developer image is formable;

a developing roller configured to supply developer to the photosensitive member while contacting the photosensitive member;

a conveyance roller configured to convey a recording sheet;

a first driving source configured to provide a driving force to the developing roller and the conveyance roller and capable of switching a rotating direction thereof between a first direction and a second direction reverse to the first direction;

a second driving source configured to provide a driving force to the photosensitive member;

a developing driving gear mechanism configured to transmit the driving force of the first driving source to the developing roller; and a conveyance driving gear mechanism configured to transmit the driving force of the first driving source to the conveyance roller, wherein the conveyance driving gear mechanism is configured to cause a rotating direction of the conveyance roller when the first driving source rotates in the first direction to be reverse to the rotating direction of the conveyance roller when the first driving source rotates in the second direction, and wherein the developing driving gear mechanism includes a developing driving switching mechanism configured to cause a rotating direction of the developing roller when the first driving source rotates in the first direction to be the same as the rotating direction of the developing roller when the first driving source rotates in the second direction.

2. The image forming apparatus according to claim 1, wherein the developing driving switching mechanism includes:

a developing driving sun gear; and a developing driving swing gear configured to swing around the developing driving sun gear, and wherein when the rotating direction of the first driving source is switched, the developing driving swing gear swings, so that a gear to be meshed with the developing driving swing gear changes.

3. The image forming apparatus according to claim 1, wherein the developing driving switching mechanism includes:

a first swing gear configured to swing between a first transmission position at which the driving force from the first driving source can be transmitted to the developing roller and a first interruption position at which the driving force from the first driving source cannot be transmitted to the developing roller; and a second swing gear configured to swing between a second transmission position at which the driving force from the first driving source can be transmitted to the developing roller and a second interruption position at which the driving force from the first driving source cannot be transmitted to the developing roller, and configured to be rotated in a direction reverse to a rotation direction of the first swing gear, and wherein when the first driving source rotates in the first direction, the first swing gear swings to the first interruption position and the second swing gear swings to the second transmission position, and when the first driving source rotates in the second direction, the first swing gear swings to the first transmission position and the second swing gear swings to the second interruption position.

4. The image forming apparatus according to claim 3, further comprising:

a fixing device configured to heat-fix a developer image transferred on a recording sheet; and a fixing driving output gear configured to mesh with the first swing gear when the first swing gear swings to the first interruption position, so that the driving force from the first driving source can be transmitted to the fixing device, and configured to release the mesh with the first swing gear when the first swing gear swings to the first transmission position, so that the driving force from the first driving source cannot be transmitted to the fixing device.

5. The image forming apparatus according to claim 4, wherein the developing roller includes:

a first developing roller to which the driving force from the first driving source is provided; and a second developing roller to which the driving force from the first driving source is not transmitted and the driving force from the second driving source is provided, and wherein the photosensitive member is provided in correspondence to each of the first developing roller and the second developing roller.

6. The image forming apparatus according to claim 5, wherein the image forming apparatus is configured to operate in a monochrome mode in which only black developer is used to form a monochrome image and to operate in a color mode in which developer of a plurality of colors are used to form a color image.

7. The image forming apparatus according to claim 6, wherein the first developing roller is configured to supply black developer.

8. The image forming apparatus according to claim 5, further comprising:

an endless belt which is arranged to face a plurality of photosensitive members, wherein the belt is configured such that the driving force from the second driving source is provided thereto.

9. The image forming apparatus according to claim 5, wherein the first developing roller is arranged at a position closer to the fixing device than the second developing roller.

10. The image forming apparatus according to claim 3, wherein the developing driving switching mechanism includes:

a first sun gear to which the driving force from the first driving source is provided, and around which the second swing gear can swing;

a second sun gear which is meshed with the first sun gear, and around which the first swing gear can swing; and a developing driving output gear which is meshed with either one of the first swing gear and the second swing gear to transmit the driving force to the developing roller, and wherein when the first driving source rotates in the first direction, the second swing gear is meshed with the developing driving output gear, and when the first driving source rotates in the second direction, the first swing gear is meshed with the developing driving output gear.

* * * * *